US011804661B2

(12) United States Patent
Kaushal et al.

(10) Patent No.: US 11,804,661 B2
(45) Date of Patent: Oct. 31, 2023

(54) ARRAY ANTENNA

(71) Applicant: FUJIKURA LTD., Tokyo (JP)

(72) Inventors: Shailendra Kaushal, Sakura (JP); Ning Guan, Sakura (JP); Asahi Kan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 271 days.

(21) Appl. No.: 17/430,004

(22) PCT Filed: Mar. 18, 2020

(86) PCT No.: PCT/JP2020/011931
§ 371 (c)(1),
(2) Date: Aug. 11, 2021

(87) PCT Pub. No.: WO2020/255503
PCT Pub. Date: Dec. 24, 2020

(65) Prior Publication Data

US 2022/0149539 A1 May 12, 2022

(30) Foreign Application Priority Data

Jun. 18, 2019 (JP) ..... 2019-112683

(51) Int. Cl.
*H01Q 1/38* (2006.01)
*H01Q 21/00* (2006.01)
(Continued)

(52) U.S. Cl.
CPC ..... *H01Q 21/0075* (2013.01); *H01Q 1/38* (2013.01); *H01Q 13/08* (2013.01); *H01Q 21/06* (2013.01)

(58) Field of Classification Search
CPC ..... H01Q 1/38; H01Q 21/0075; H01Q 21/06; H01Q 13/08
(Continued)

(56) References Cited

U.S. PATENT DOCUMENTS 11,646,501 B2 * 5/2023 Wu ..... H01Q 21/065 343/702
2016/0301129 A1 * 10/2016 Ying ..... H01Q 1/523
(Continued)

FOREIGN PATENT DOCUMENTS

JP 3440298 B2 8/2003
JP 2017-73736 A 4/2017
(Continued)

OTHER PUBLICATIONS

International Search Report dated Jun. 9, 2020, issued in counterpart application No. PCT/JP2020/011931, w/English translation (5 pages).
(Continued)

*Primary Examiner* — Peguy Jean Pierre
(74) *Attorney, Agent, or Firm* — WHDA, LLP

(57) ABSTRACT

Wiring and a wiring path of a feed line for feeding power to a radiation element is simplified. An array antenna includes a first conductive pattern layer, first dielectric layer, conductive ground layer, second dielectric layer, second conductive pattern layer, third dielectric layer, and radiation element pattern layer that are layered in this order. The radiation element pattern layer includes radiation element pairs arranged in a two-dimensional array pattern. Each of the radiation element pairs includes a first radiation element and a second radiation element arranged side by side with an interval therebetween. The second conductive pattern layer includes branch feed lines arranged in a two-dimensional array pattern to correspond to the radiation element pairs, respectively. The first conductive pattern layer includes feed lines corresponding to the branch feed lines, respectively.

5 Claims, 21 Drawing Sheets

(51) Int. Cl.
*H01Q 13/08* (2006.01)
*H01Q 21/06* (2006.01)

(58) Field of Classification Search
USPC ..... 343/702, 700 MS
See application file for complete search history.

(56) References Cited

U.S. PATENT DOCUMENTS

| | | | | |
|---|---|---|---|---|
| 2018/0309210 | A1 | 10/2018 | Sudo | |
| 2019/0267697 | A1* | 8/2019 | Quinlan | H01Q 1/36 |

FOREIGN PATENT DOCUMENTS

| | | | |
|---|---|---|---|
| JP | 2018-186337 | A | 11/2018 |
| JP | 2019-57890 | A | 4/2019 |

OTHER PUBLICATIONS

Written Opinion dated Jun. 9, 2020, issued in counterpart application No. PCT/JP2020/011931 (4 pages).
Notice of Reasons for Refusal dated Feb. 17, 2021, issued in counterpart Japanese Patent Application No. 2019-112683, w/English translation (8 pages).

* cited by examiner

ARRAY ANTENNA

TECHNICAL FIELD

The present disclosure relates to an array antenna.

BACKGROUND ART

Patent Literature 1 discloses a technique for controlling directivity of an array antenna including a plurality of array elements arranged in rows. In general, when signals of array elements are in phase, directivity in a direction perpendicular to an array antenna is high, and, when a phase difference occurs in signals of the array elements, directivity in a direction oblique to the direction perpendicular to the array antenna is high. Accordingly, directivity of the array antenna can be controlled by controlling a phase difference in signals of the array elements.

Meanwhile, an arrangement of a plurality of radiation elements in a two-dimensional array pattern in an array antenna (also referred to as an antenna array) and individual control of phases of signals of the radiation elements enable more precise control of directivity of the array antenna. However, this needs individual power feeding to the radiation elements so as to individually control phases of signals of the radiation elements. A microstrip line or the like is used for feeding power to the radiation elements.

CITATION LIST

Patent Literature

Patent Literature 1: Japanese Patent No. 3440298

SUMMARY OF INVENTION

Technical Problem

As the number of radiation elements increases, the number of microstrip lines also increases. Taking it consideration that the lengths of the lines are an important parameter in terms of phases, complicates a wiring design of microstrip lines.

Thus, the present disclosure is directed to simplification of wiring and a wiring path of a feed line for feeding power to a radiation element.

Solution to Problem

A main aspect of the present disclosure is an array antenna comprising: a first conductive pattern layer, a first dielectric layer, a conductive ground layer, a second dielectric layer, a second conductive pattern layer, a third dielectric layer, and a radiation element pattern layer that are layered in this order; a plurality of first through hole conductors and a plurality of second through hole conductors, the plurality of first and second through hole conductors penetrating the third dielectric layer; and a plurality of third through hole conductors penetrating the first dielectric layer, the conductive ground layer, and the second dielectric layer, wherein the radiation element pattern layer includes a plurality of radiation element pairs arranged in a two-dimensional array pattern, each of the plurality of radiation element pairs includes a first radiation element and a second radiation element that are arranged side by side so as to be separated from each other, the plurality of first through hole conductors are arranged in a two-dimensional array pattern so as to correspond to the plurality of first radiation elements, respectively, to be electrically connected to the plurality of first radiation elements, respectively, the plurality of second through hole conductors are arranged in a two-dimensional array pattern so as to correspond to the plurality of second radiation elements, respectively, to be electrically connected to the plurality of second radiation elements, respectively, the second conductive pattern layer includes a plurality of branch feed lines arranged in a two-dimensional array pattern so as to correspond to the plurality of radiation element pairs, respectively, the plurality of third through hole conductors are arranged in a two-dimensional array pattern so as to correspond to the plurality of branch feed lines, respectively, to be electrically connected to the plurality of branch feed lines, respectively, each of the plurality of branch feed lines branches into a first line and a second line, the first line being configured to electrically connect the third through hole conductor and the first through hole conductor, the second line being configured to electrically connect the third through hole conductor and the second through hole conductor, the first conductive pattern layer includes a plurality of feed lines corresponding to the plurality of branch feed lines, respectively, the conductive ground layer includes a plurality of slots arranged in a two-dimensional array pattern so as to correspond to the plurality of branch feed lines, respectively, each of the plurality of feed lines is routed to a position at which the each of the feed lines overlaps each of the slots in a plan view, and each of the plurality of third through hole conductors is arranged on an inner side of each of the slots in a plan view, so as to be electrically insulated from the conductive ground layer and be electrically connected to each of the feed lines.

Other features of the disclosure become apparent from the following description and drawings.

Advantageous Effects of Invention

According to the present disclosure, it is possible to freely design an arrangement, a wiring path, and the like of a feed line, and simplify wiring and a wiring path of the feed line, regardless of a location, a size, a range, and the like of a branch feed line.

DESCRIPTION OF EMBODIMENTS

Figure 1:
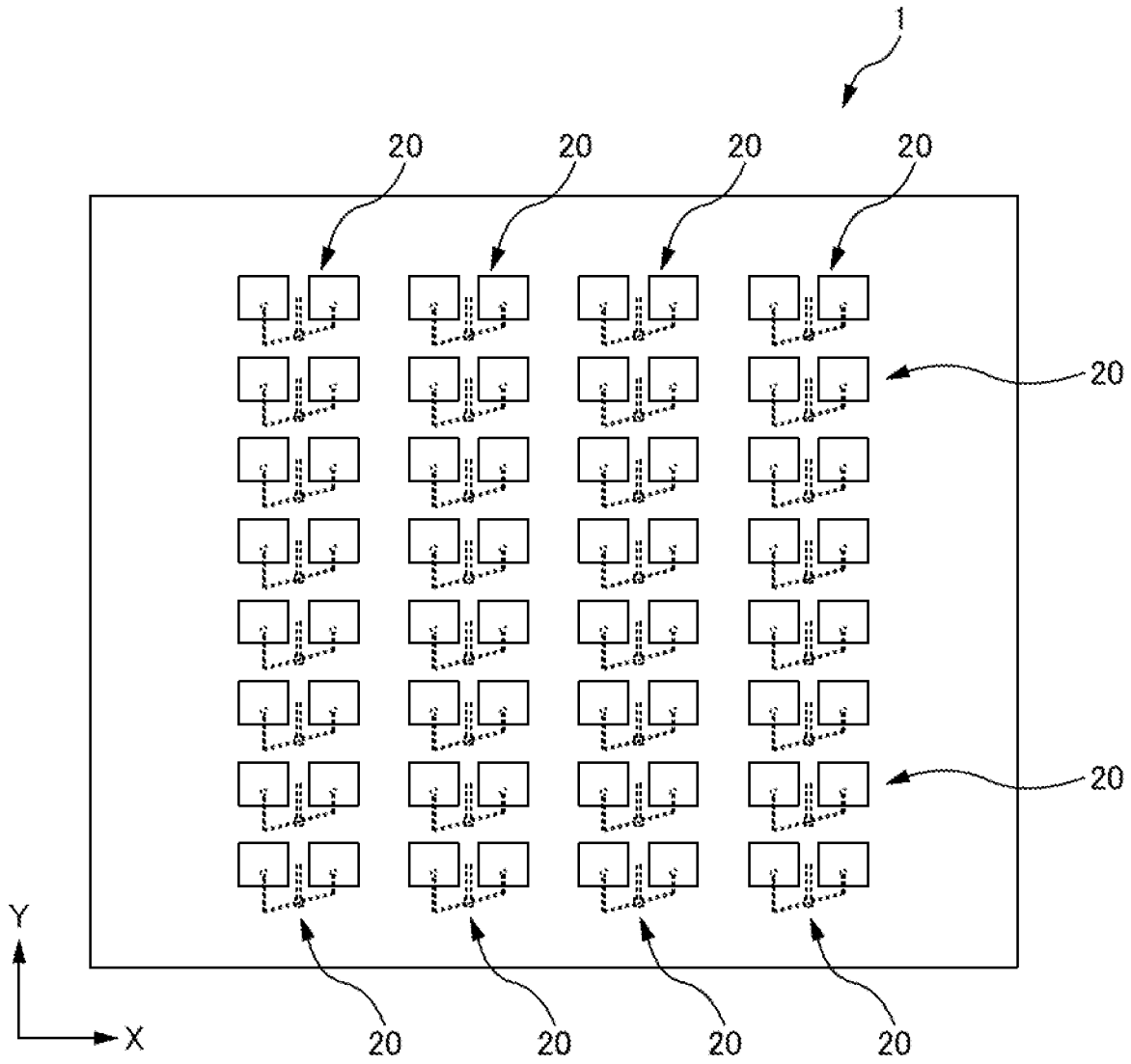
FIG. 1 is a plan view of an array antenna according to a first embodiment.

At least the following matters are become apparent from the following description and the drawings.

Disclosed is an array antenna comprising: a first conductive pattern layer, a first dielectric layer, a conductive ground layer, a second dielectric layer, a second conductive pattern layer, a third dielectric layer, and a radiation element pattern layer that are layered in this order; a plurality of first through hole conductors and a plurality of second through hole conductors, the plurality of first and second through hole conductors penetrating the third dielectric layer; and a plurality of third through hole conductors penetrating the first dielectric layer, the conductive ground layer, and the second dielectric layer, wherein the radiation element pattern layer includes a plurality of radiation element pairs arranged in a two-dimensional array pattern, each of the plurality of radiation element pairs includes a first radiation element and a second radiation element that are arranged side by side so as to be separated from each other, the plurality of first through hole conductors are arranged in a two-dimensional array pattern so as to correspond to the plurality of first radiation elements, respectively, to be electrically connected to the plurality of first radiation elements, respectively, the plurality of second through hole conductors are arranged in a two-dimensional array pattern so as to correspond to the plurality of second radiation elements, respectively, to be electrically connected to the plurality of second radiation elements, respectively, the second conductive pattern layer includes a plurality of branch feed lines arranged in a two-dimensional array pattern so as to correspond to the plurality of radiation element pairs, respectively, the plurality of third through hole conductors are arranged in a two-dimensional array pattern so as to correspond to the plurality of branch feed lines, respectively, to be electrically connected to the plurality of branch feed lines, respectively, each of the plurality of branch feed lines branches into a first line and a second line, the first line being configured to electrically connect the third through hole conductor and the first through hole conductor, the second line being configured to electrically connect the third through hole conductor and the second through hole conductor, the first conductive pattern layer includes a plurality of feed lines corresponding to the plurality of branch feed lines, respectively, the conductive ground layer includes a plurality of slots arranged in a two-dimensional array pattern so as to correspond to the plurality of branch feed lines, respectively, each of the plurality of feed lines is routed to a position at which the each of the feed lines overlaps each of the slots in a plan view, and each of the plurality of third through hole conductors is arranged on an inner side of each of the slots in a plan view, so as to be electrically insulated from the conductive ground layer and be electrically connected to each of the feed lines.

As described above, the feed line and the branch feed line are formed in different layers. Thus, it is possible to freely design an arrangement, a wiring path, and the like of the feed line, and simplify wiring and a wiring path of the feed line, regardless of a location, a size, a range, and the like of the branch feed line.

A length of the first line is different from a length of the second line.

This makes it possible to widen a frequency band available in the array antenna.

The first line includes a first line part extending from the third through hole conductor to a first-radiation-element side, and a second line part extending from an end portion, of the first line part, distal from the third through hole conductor toward the first through hole conductor, and the second line includes a third line part extending from the third through hole conductor in a direction opposite to the first line part, and a fourth line part extending from an end portion, of the third line part, distal from the third through hole conductor toward the second through hole conductor, the fourth line part being parallel to the second line part.

It is preferable that the first line part and the third line part have an angle with respect to a direction orthogonal to the second line part and the fourth line part.

It is also preferable that the first line part and the third line part have lengths equal to each other, and the second line part and the fourth line part have lengths different from each other.

This enables the first line and the second line to have lengths different from each other. Thus, it is possible to widen a frequency band available in the array antenna.

EMBODIMENTS

Embodiments of the disclosure are described below with reference to the drawings. Note that, although various limitations that are technically preferable for carrying out the disclosure are imposed on the embodiments to be described below, the scope of the disclosure is not to be limited to the embodiments and illustrated examples below.

First Embodiment

Figure 2:
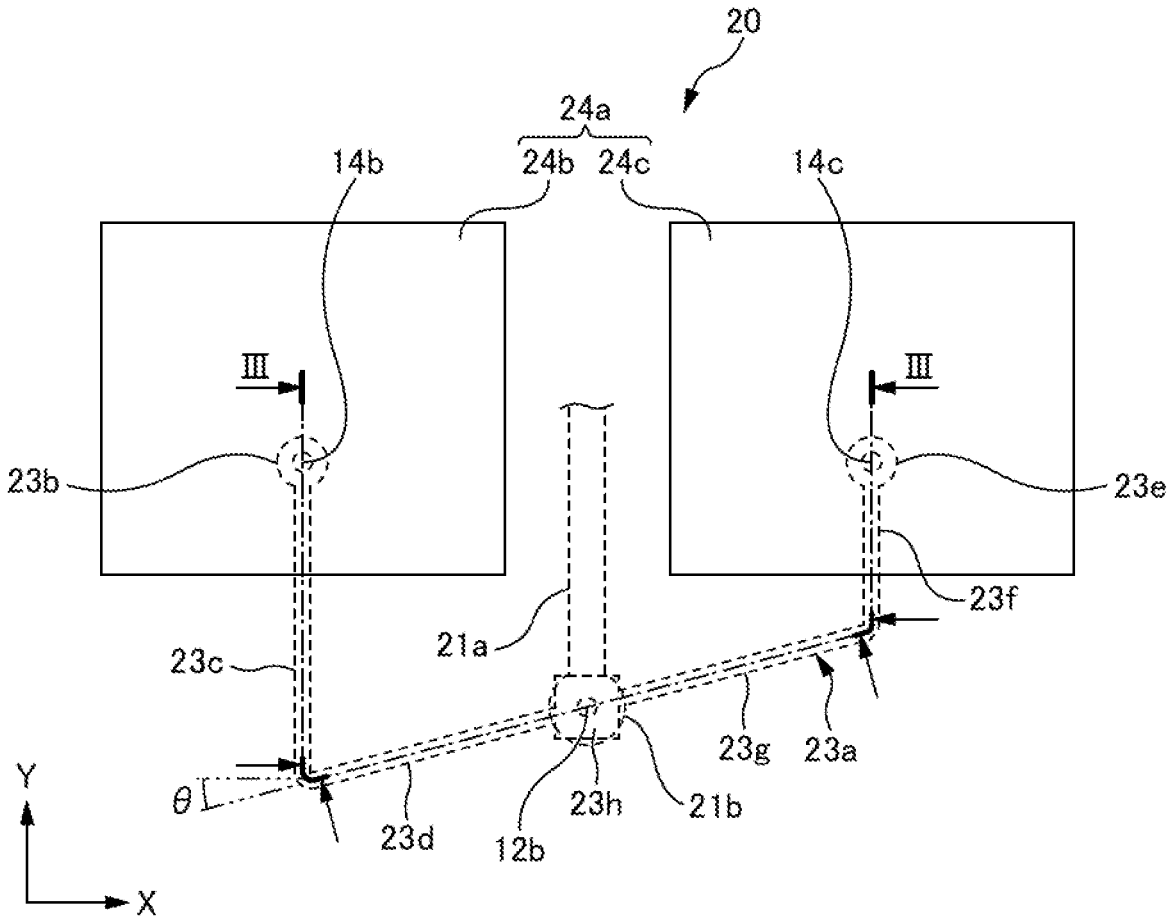
FIG. 2 is a plan view of one antenna set included in an array antenna according to a first embodiment.

FIG. 1 is a plan view of an array antenna 1 according to a first embodiment, and FIG. 2 is a plan view illustrating one antenna set 20. FIGS. 1 and 2 give an X axis and a Y axis orthogonal to each other, as auxiliary lines representing directions.

The array antenna 1 is used for transmitting, receiving, or both transmitting and receiving a radio wave in a frequency band of a microwave or a millimeter wave.

As illustrated in FIGS. 1 and 2, the array antenna 1 includes a plurality of the antenna sets 20, and each of the antenna sets 20 includes a radiation element pair 24*a*, a branch feed line 23*a*, a feed line 21*a*, a first through hole conductor 14*b*, a second through hole conductor 14*c*, and a third through hole conductor 12*b*.

Each of the radiation element pairs 24*a* includes a first radiation element 24*b* and a second radiation element 24*c* that are arranged side by side so as to be separated from each other in an X-axis direction and have a rectangular shape or a square shape. The radiation element pairs 24*a* are arranged in a two-dimensional array pattern, particularly, a grid pattern. The first radiation elements 24*b* and the second radiation elements 24*c* are also arranged in a grid pattern as a whole. In other words, the first radiation elements 24*b* are linearly arranged in a Y-axis direction at predetermined intervals, the second radiation elements 24*c* are linearly arranged in the Y-axis direction at intervals equal to the intervals of the first radiation elements 24*b*, and the first radiation elements 24*b* and the second radiation elements 24*c* are alternately arranged linearly in the X-axis direction.

A plurality of the branch feed lines 23*a* are arranged in a two-dimensional array pattern, particularly, a grid pattern, so as to correspond to the plurality of radiation element pairs 24*a*, respectively. A plurality of the feed lines 21*a* are arranged so as to correspond to the plurality of branch feed lines 23*a*, respectively. A plurality of the first through hole conductors 14*b* are arranged in a two-dimensional array pattern, particularly, a grid pattern, so as to correspond to the plurality of first radiation elements 24*b*, respectively. A plurality of the second through hole conductors 14*c* are arranged in a two-dimensional array pattern, particularly, a grid pattern so as to correspond to the plurality of second radiation elements 24*c*, respectively. A plurality of the third through hole conductors 12*b* are arranged in a two-dimensional array pattern, particularly, a grid pattern, so as to correspond to the plurality of branch feed lines 23*a*, respectively.

Figure 3:
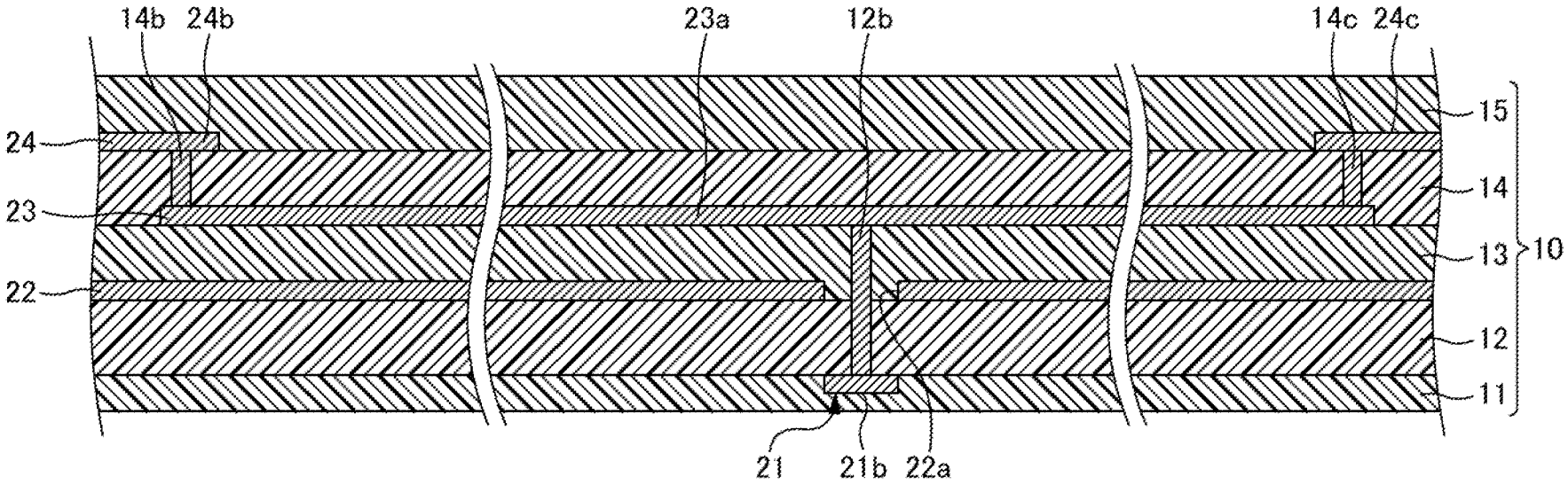
FIG. 3 is a combined cross-sectional view taken along a III-III line.

With reference to FIG. 3, a layer structure of the array antenna 1 will be described. FIG. 3 is a cross-sectional view that is taken along a III-III line of FIG. 2, and a direction of projection of which is indicated by arrows in FIG. 2. An illustrated range of FIG. 3 is a range corresponding to one antenna set 20.

A protective dielectric layer 11, a first dielectric layer 12, a second dielectric layer 13, a third dielectric layer 14, and a fourth dielectric layer 15 are layered in this order, and a dielectric layered body 10 formed of the dielectric layers 11 to 15 is formed. The protective dielectric layer 11, the first dielectric layer 12, the second dielectric layer 13, the third dielectric layer 14, and the fourth dielectric layer 15 are made of, for example, a liquid crystal polymer. A radio frequency integrated circuit (RFIC), not illustrated, is surface-mounted in a front surface or a back surface of the dielectric layered body 10. The front surface of the dielectric layered body 10 refers to a surface of the fourth dielectric layer 15, and the back surface of the dielectric layered body 10 refers to a surface of the protective dielectric layer 11. The RFIC is a transmitter, a receiver, or a transceiver.

A first conductive pattern layer 21 is formed between the protective dielectric layer 11 and the first dielectric layer 12. The protective dielectric layer 11 is formed on a surface of the first dielectric layer 12 so as to cover the first conductive pattern layer 21. Accordingly, the first conductive pattern layer 21 is protected. Note that the first conductive pattern layer 21 may be exposed without the protective dielectric layer 11 being formed.

A conductive ground layer 22 is formed between the first dielectric layer 12 and the second dielectric layer 13. The second dielectric layer 13 covers the conductive ground layer 22, to be joined to the conductive ground layer 22, and also joined to the first dielectric layer 12 in a portion (for example, a hole, a slot, a notch, and/or the like) without the conductive ground layer 22.

A second conductive pattern layer 23 is formed between the second dielectric layer 13 and the third dielectric layer 14. The third dielectric layer 14 covers the second conductive pattern layer 23, while being joined to the second conductive pattern layer 23, and also joined to the second dielectric layer 13 in a portion without the second conductive pattern layer 23.

A radiation element pattern layer 24 is formed between the third dielectric layer 14 and the fourth dielectric layer 15. The fourth dielectric layer 15 covers the radiation element pattern layer 24, while being joined to the radiation element pattern layer 24, and is also joined to the third dielectric layer 14 in a portion without the radiation element pattern layer 24.

The protective dielectric layer 11 may be formed of a single layer of a dielectric, or may be formed of a layered body of dielectrics. The same applies to the dielectric layers 12, 13, 14, and 15.

The first conductive pattern layer 21, the conductive ground layer 22, the second conductive pattern layer 23, and the radiation element pattern layer 24 are formed of a conductive metal material such as copper and/or the like.

The radiation element pattern layer 24, the second conductive pattern layer 23, the conductive ground layer 22, and the first conductive pattern layer 21 are processed and shaped by an additive method, a subtractive method, or the like. Accordingly, the plurality of first radiation elements 24*b* and the plurality of second radiation elements 24*c* are formed in the radiation element pattern layer 24, the plurality of branch feed lines 23*a* are formed in the second conductive pattern layer 23, a plurality of slots 22*a* are formed in the conductive ground layer 22, and the plurality of feed lines 21*a* are formed in the first conductive pattern layer 21. Since the first dielectric layer 12 is interposed between the feed line 21*a* and the conductive ground layer 22, the feed line 21*a* functions as a microstrip line. Since the second dielectric layer 13 is interposed between the branch feed line 23*a* and the conductive ground layer 22, the branch feed line 23*a* functions as a microstrip line.

Similarly to the radiation element pairs 24*a* as illustrated in FIG. 1, the plurality of slots 22*a* (illustrated in FIG. 3) are arranged in a two-dimensional array pattern, particularly, a grid pattern. The feed line 21*a* is routed from a position at which the feed line 21*a* overlaps the slot 22*a* to a position at which the feed line 21*a* overlaps a terminal of the RFIC in a plan view. Here, a plan view refers to viewing a target such as the array antenna 1 in parallel projection in a direction of a Z axis orthogonal to both the X axis and the Y axis.

As described above, the feed line 21*a* and the branch feed line 23*a* are formed in different layers. Thus, it is possible to freely design an arrangement, wiring path, and the like of the feed line 21*a*, and simplify the wiring and wiring path of the feed line 21*a*, regardless of the location, size, range, and the like of the branch feed line 23*a*. For example, the arrangement, wiring path, and the like of the feed line 21*a* can be designed such that the feed line 21*a* of a certain antenna set 20 partially overlaps the branch feed line 23*a* of another antenna set 20 in a plan view.

With reference to FIG. 2, each antenna set 20 will be described in detail.

As described above, the first radiation element 24*b* and the second radiation element 24*c* are adjacent to each other with an interval therebetween.

A land part 21*b* is formed on an end portion (portion overlapping the third through hole conductor 12*b* in a plan view) of the feed line 21*a* distal from the RFIC.

The branch feed line 23*a* includes a land part 23*b*, a line part 23*c*, a line part 23*d*, a land part 23*e*, a line part 23*f*, a line part 23*g*, and a land part 23*h*.

The land part 23*b* is arranged at a position at which it overlaps the first radiation element 24*b* in a plan view, and the land part 23*e* is arranged at a position at which it overlaps the second radiation element 24*c* in a plan view. The land part 23*b* and the land part 23*e* are aligned in the Y-axis direction. The land part 23*h* is arranged at a position shifted in the Y-axis direction from the first radiation element 24*b* and the second radiation element 24*c*, and at a midpoint between the first radiation element 24*b* and the second radiation element 24*c* in the X-axis direction.

The line part 23*d* linearly extends from the land part 23*h* to the first-radiation-element 24*b* side, and the line part 23*g* linearly extends from the land part 23*h* in a direction opposite to the line part 23*d*. The line part 23*c* linearly extends in the Y-axis direction from an end portion, of the line part 23*d*, distal from the land part 23*h* toward the land part 23*b*, and the line part 23*f* linearly extends in the Y-axis direction from an end portion, of the line part 23*g*, distal from the land part 23*h* toward the land part 23*e*. The line part 23*c* and the line part 23*f* are parallel to each other, and are also orthogonal to the X-axis direction.

Here, the line part 23*d* and the line part 23*g* are linear to each other, and the line part 23*d* and the line part 23*g* extend from the land part 23*h* in directions opposite to each other. In other words, the branch feed line 23*a* branches at the land part 23*h* into the line parts 23*d* and 23*c* and the line parts 23*g* and 23*f*. Here, a line from the land part 23*h* to the land part 23*b* along the line parts 23*d* and 23*c* corresponds to a first line, a line from the land part 23*h* to the land part 23*e* along the line parts 23*g* and 23*f* corresponds to a second line, the line part 23*d* corresponds to a first line part, the line part 23*c* corresponds to a second line part, the line part 23*g* corresponds to a third line part, and the line part 23*f* corresponds to a fourth line part.

The line part 23*d* and the line part 23*g* form an angle with respect to the X-axis direction, in other words, with respect to a direction in which the radiation elements 24*b* and 24*c* are separated from each other, and the angle formed as such is denoted by θ[° ] (see FIG. 2). The length of the line part 23*d* and the length of the line part 23*g* are equal to each other, and the sum of the lengths of the line parts 23*c* and 23*d* is greater than the sum of the lengths of the line parts 23*f* and 23*g*. The angle between the line parts 23*c* and 23*d* is an acute angle, the angle between the line parts 23*f* and 23*g* is an obtuse angle, and the sum of the angle between the line parts 23*c* and 23*d* and the angle between the line parts 23*f* and 23*g* is 180°.

The land part 23*b* is configured to be electrically connected to the radiation element 24*b* with the first through hole conductor 14*b* penetrating the third dielectric layer 14. The land part 23*e* is configured to be electrically connected to the radiation element 24*c* with the second through hole conductor 14*c* penetrating the third dielectric layer 14. The land part 23*h* is configured to be electrically connected, with the third through hole conductor 12*b* penetrating the first dielectric layer 12, the conductive ground layer 22, and the second dielectric layer 13, to the land part 21*b* formed on the end portion of the feed line 21*a* proximal to the third through hole conductor 12*b*. Here, the third through hole conductor 12*b* is separated from the edge of the slot 22*a* toward the inside of the slot 22*a* in a plan view. Thus, the third through hole conductor 12*b* is electrically insulated from the conductive ground layer 22.

In the branch feed line 23*a*, the physical length from the land part 23*h* to the land part 23*b* is different from the physical length from the land part 23*h* to the land part 23*e*. Thus, there is a phase difference between a signal wave transmitted from the first radiation element 24*b* to the RFIC and a signal wave transmitted from the second radiation element 24*c* to the RFIC. Similarly, there is a phase difference between a signal wave transmitted from the RFIC to the first radiation element 24*b* and a signal wave transmitted from the RFIC to the second radiation element 24*c*. Such a phase difference produces a plurality of (three) resonance frequencies, and widens a frequency band available in the array antenna 1. This has been specifically verified by simulation, and thus details will be described below.

Figure 4:
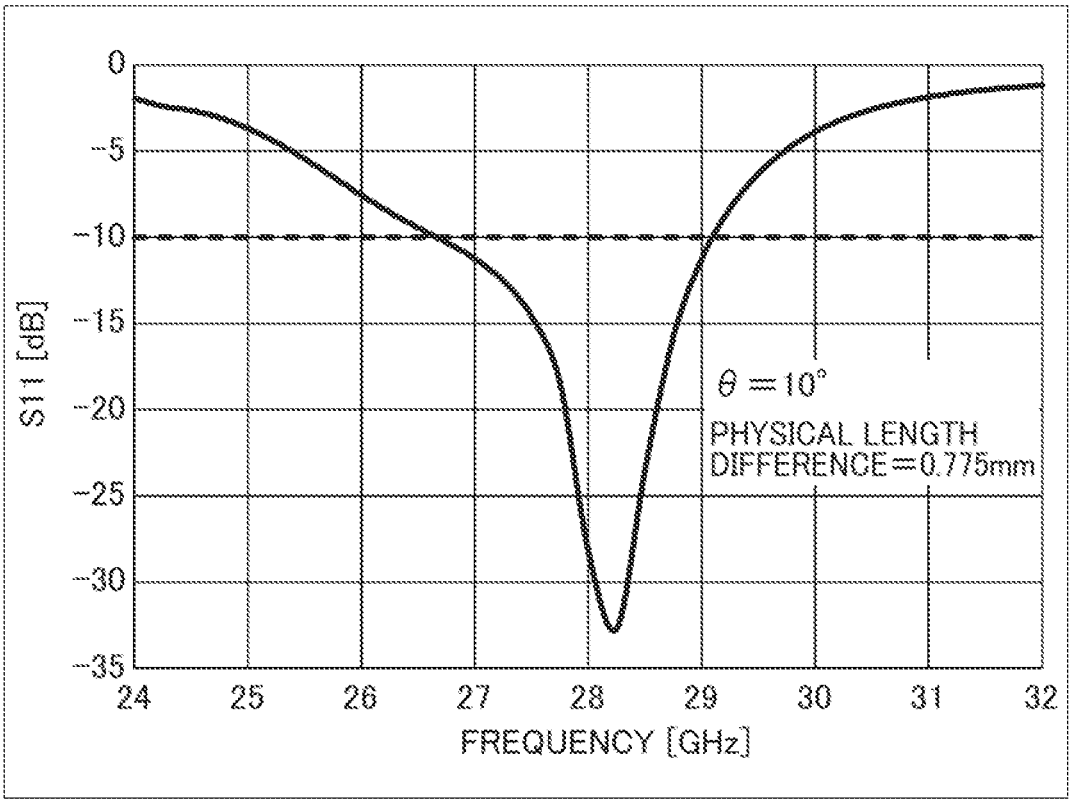
FIG. 4 is a graph illustrating a relationship between a reflection coefficient and a frequency of an array antenna according to a first embodiment when an angle θ is 10°.

FIGS. 4 to 11 are frequency characteristic diagrams each illustrating a relationship between a frequency and a reflection coefficient (S11). FIG. 4 gives a simulation result when the angle θ is 10°, and a difference (hereinafter referred to as physical length difference) between the physical length of the branch feed line 23*a* from the land part 23*h* to the land part 23*b* and the physical length of the branch feed line 23*a* from the land part 23*h* to the land part 23*e* is 0.775 mm. With respect to FIGS. 5 to 11, specific numerical values of the angle θ and the physical length difference are given in FIGS. 5 to 11.

Figure 5:
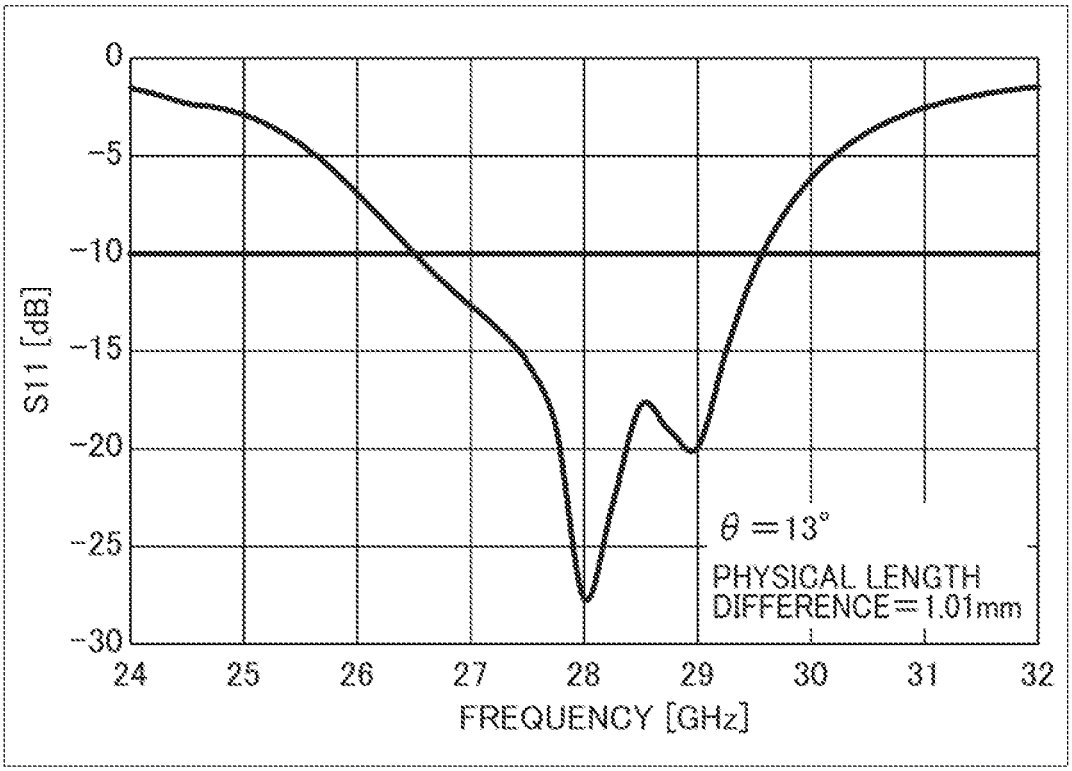
FIG. 5 is a graph illustrating a relationship between a reflection coefficient and a frequency of an array antenna according to a first embodiment when an angle θ is 13°.
Figure 6:
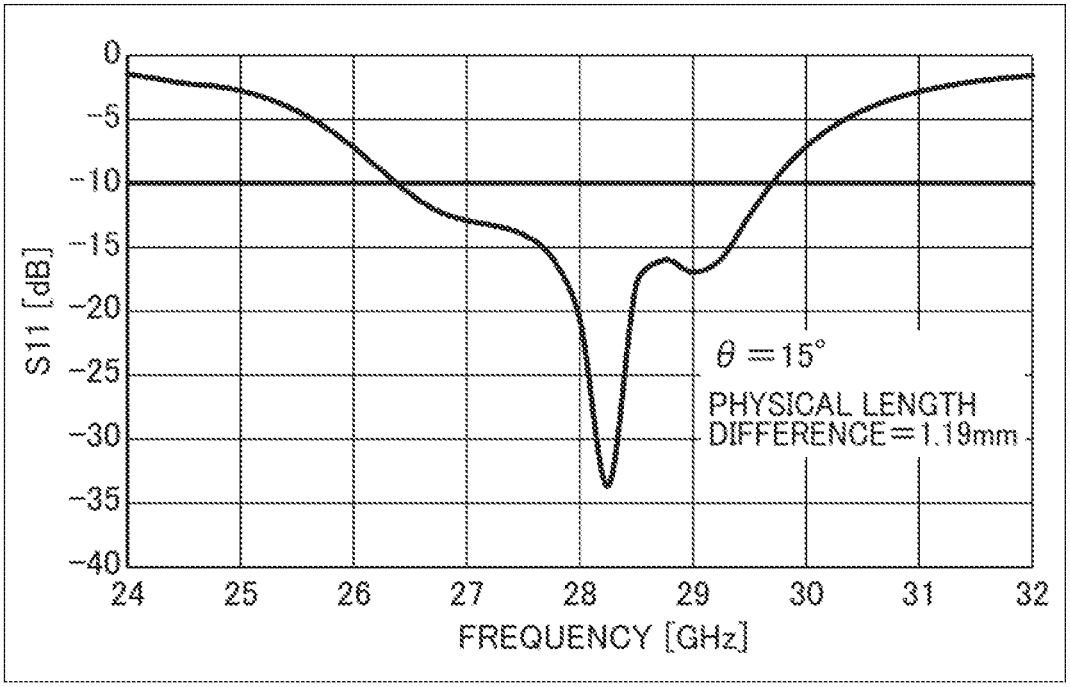
FIG. 6 is a graph illustrating a relationship between a reflection coefficient and a frequency of an array antenna according to a first embodiment when an angle θ is 15°.
Figure 7:
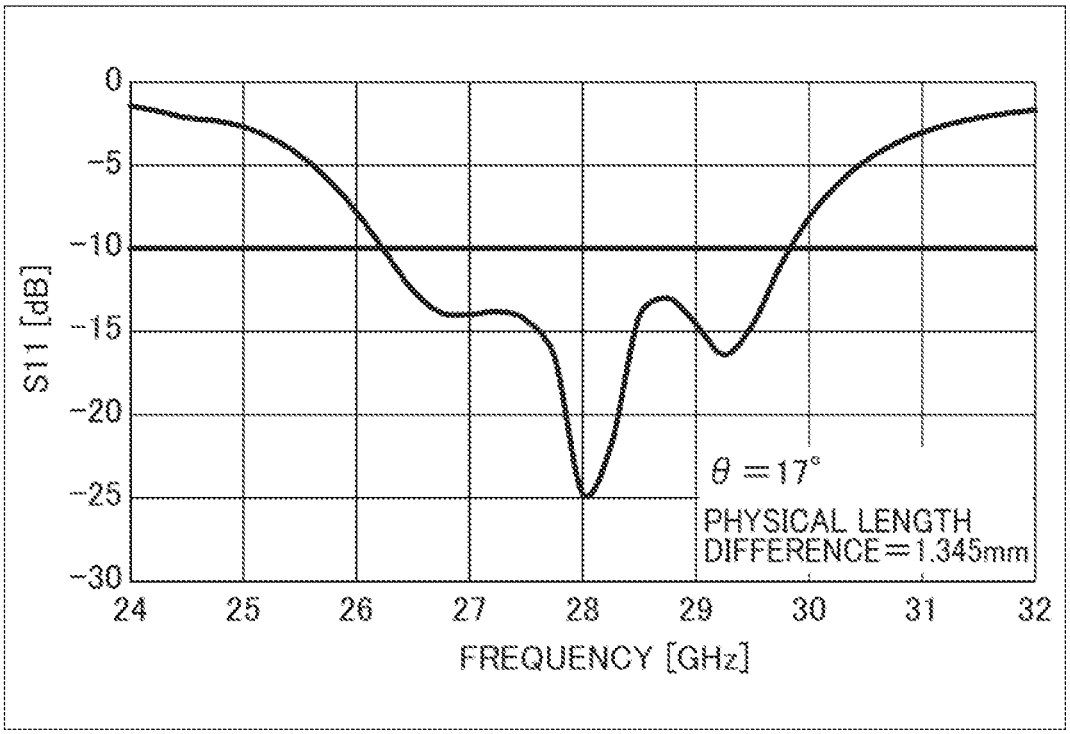
FIG. 7 is a graph illustrating a relationship between a reflection coefficient and a frequency of an array antenna according to a first embodiment when an angle θ is 17°.
Figure 8:
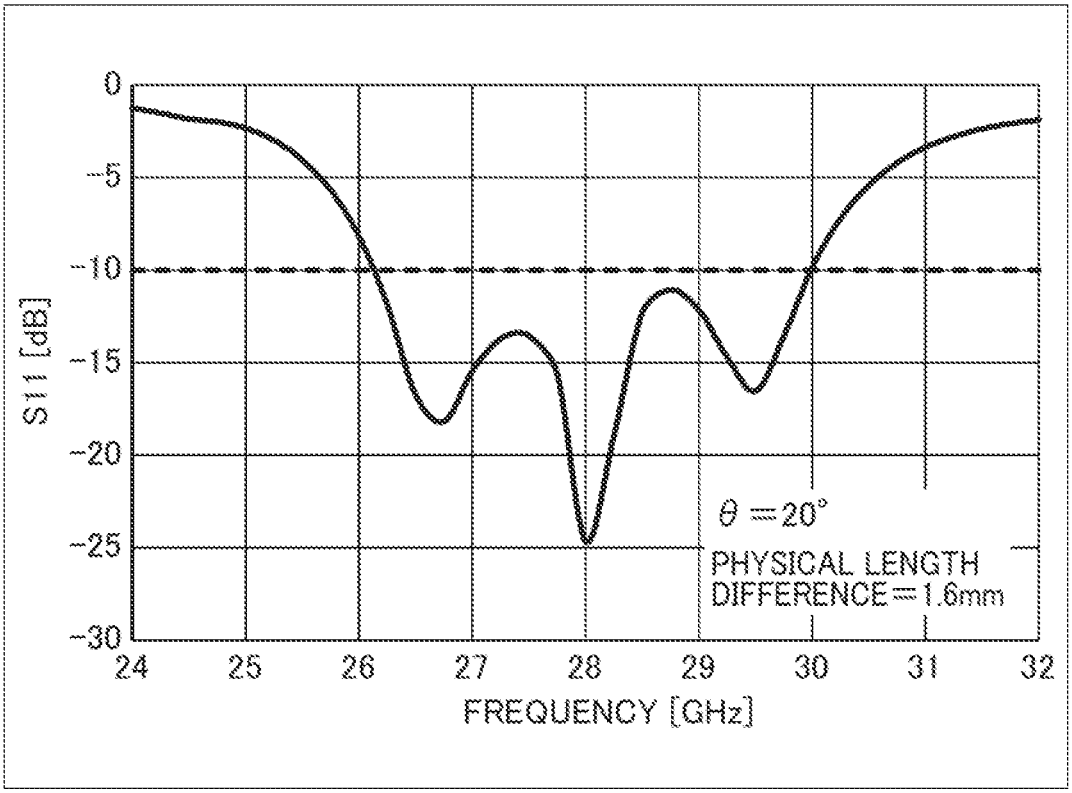
FIG. 8 is a graph illustrating a relationship between a reflection coefficient and a frequency of an array antenna according to a first embodiment when an angle θ is 20°.
Figure 9:
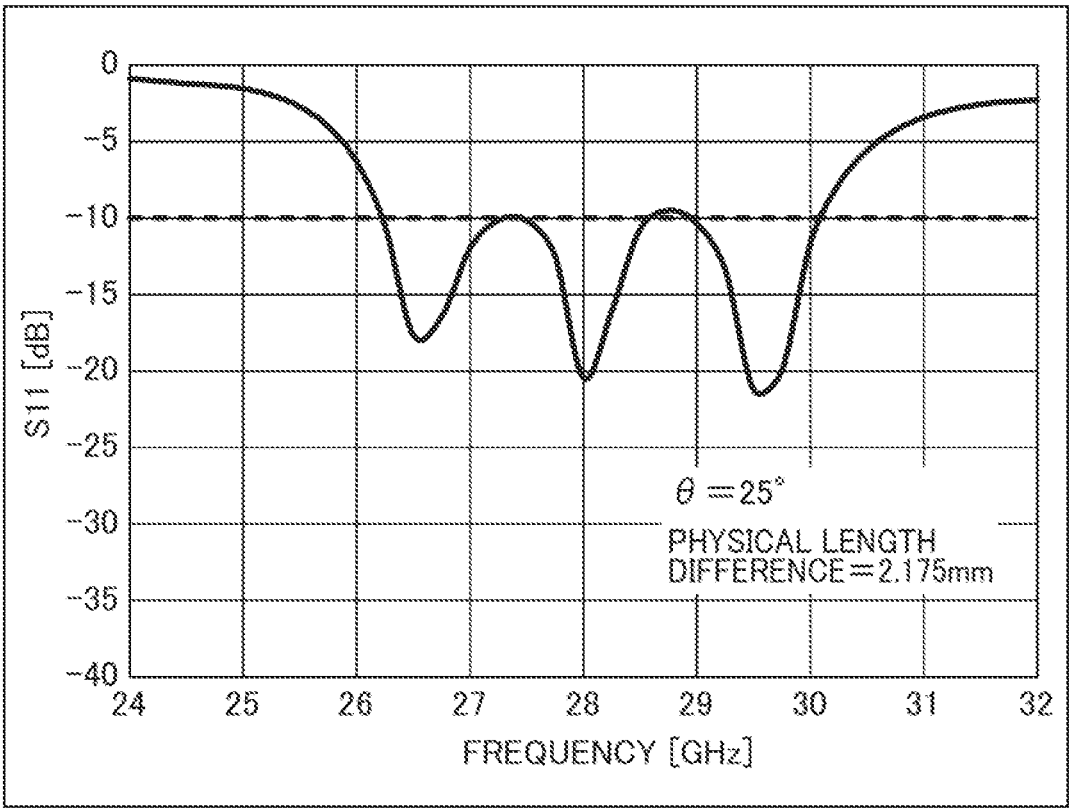
FIG. 9 is a graph illustrating a relationship between a reflection coefficient and a frequency of an array antenna according to a first embodiment when an angle θ is 25°.
Figure 10:
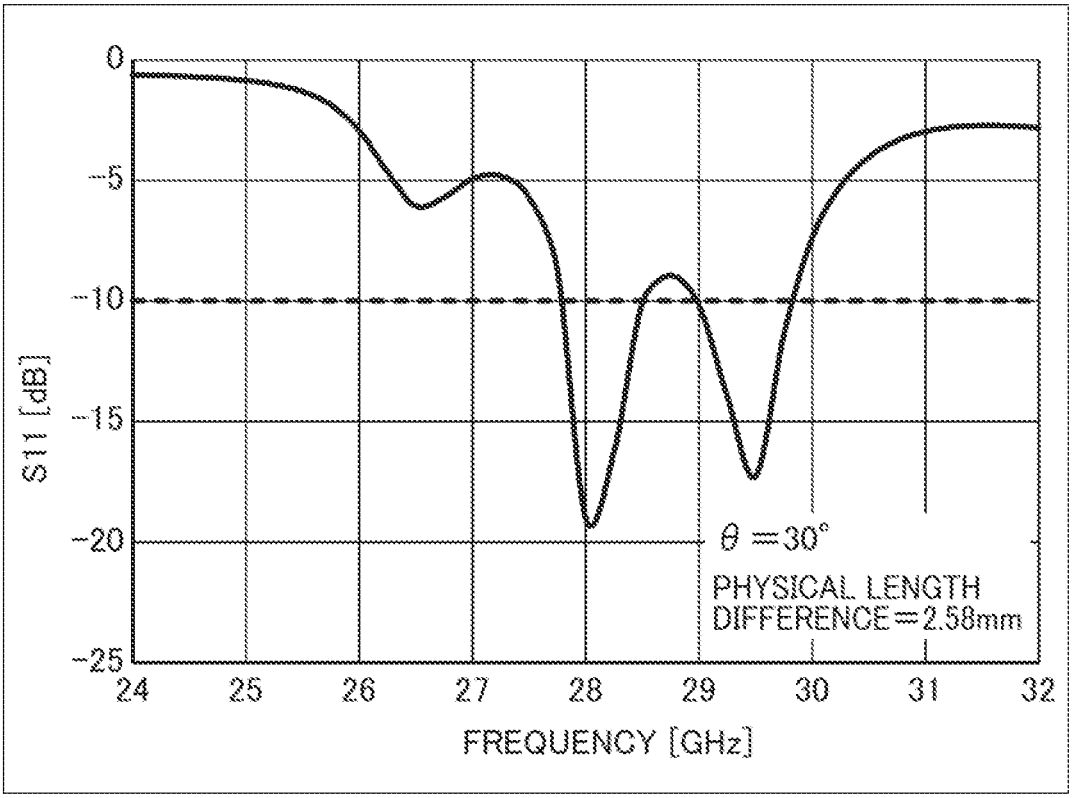
FIG. 10 is a graph illustrating a relationship between a reflection coefficient and a frequency of an array antenna according to a first embodiment when an angle θ is 30°.
Figure 11:
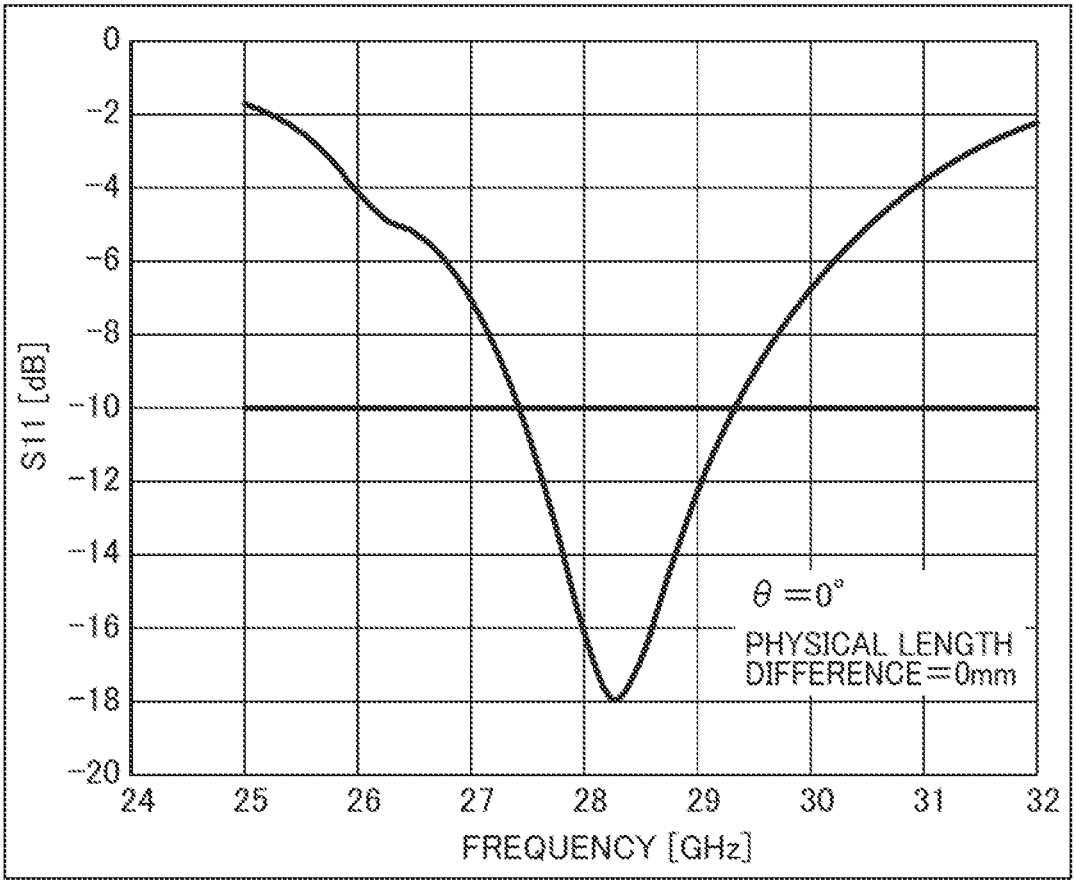
FIG. 11 is a graph illustrating a relationship between a reflection coefficient and a frequency of an array antenna when an angle θ is 0°.

As illustrated in FIG. 4, when the angle θ is 10°, a frequency band with a reflection coefficient equal to or less than −10 dB is 26.75 to 29 GHz. As illustrated in FIG. 5, when the angle θ is 13°, a frequency band with a reflection coefficient equal to or less than −10 dB is 26.5 to 29.5 GHz. As illustrated in FIG. 6, when the angle θ is 15°, a frequency band with a reflection coefficient equal to or less than −10 dB is 26.5 to 29.5 GHz. As illustrated in FIG. 7, when the angle θ is 17°, a frequency band with a reflection coefficient equal to or less than −10 dB is 26.25 to 29.75 GHz. As illustrated in FIG. 8, when the angle θ is 20°, a frequency band with a reflection coefficient equal to or less than −10 dB is 26.25 to 30 GHz. As illustrated in FIG. 9, when the angle θ is 25°, a frequency band with a reflection coefficient equal to or less than −10 dB is 26.25 to 27.5 GHz, 27.6 to 28.5 GHz, and 29.0 to 30.0 GHz. As illustrated in FIG. 10, when the angle θ is 30°, a frequency band with a reflection coefficient equal to or less than −10 dB is 28 to 28.5 GHz and 29.0 to 29.75 GHz. As illustrated in FIG. 11, when the angle θ is 0°, a frequency band with a reflection coefficient equal to or less than −10 dB is 27.5 to 29.3 GHz.

Figure 12:
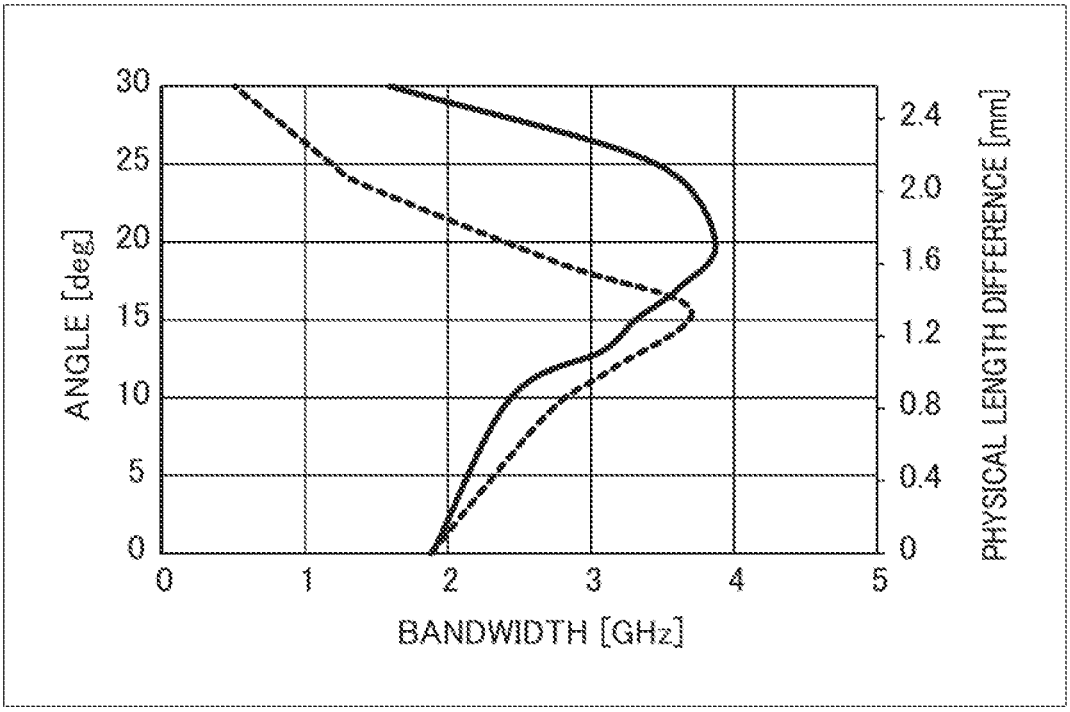
FIG. 12 is a graph illustrating a relationship between a frequency band used and an angle θ.

A summary of the above is given by a solid line in a graph in FIG. 12. FIG. 12 is the graph giving a relationship among a frequency bandwidth having a reflection coefficient equal to or less than −10 dB, the angle θ, and the physical length difference. As is apparent from the solid line in FIG. 12, a frequency bandwidth in a range from when the angle θ exceeds 0° to when the angle θ is less than approximately 29° is wider than a frequency bandwidth when the angle θ is 0°. In other words, it is understood that a frequency band available in the array antenna 1 is wider, when the physical length of the branch feed line 23*a* from the land part 23*h* to the land part 23*b* is different from the physical length of the branch feed line 23*a* from the land part 23*h* to the land part 23*e*, with the line part 23*d* and the line part 23*g* being oblique to the X-axis direction.

Second Embodiment

Figure 13:
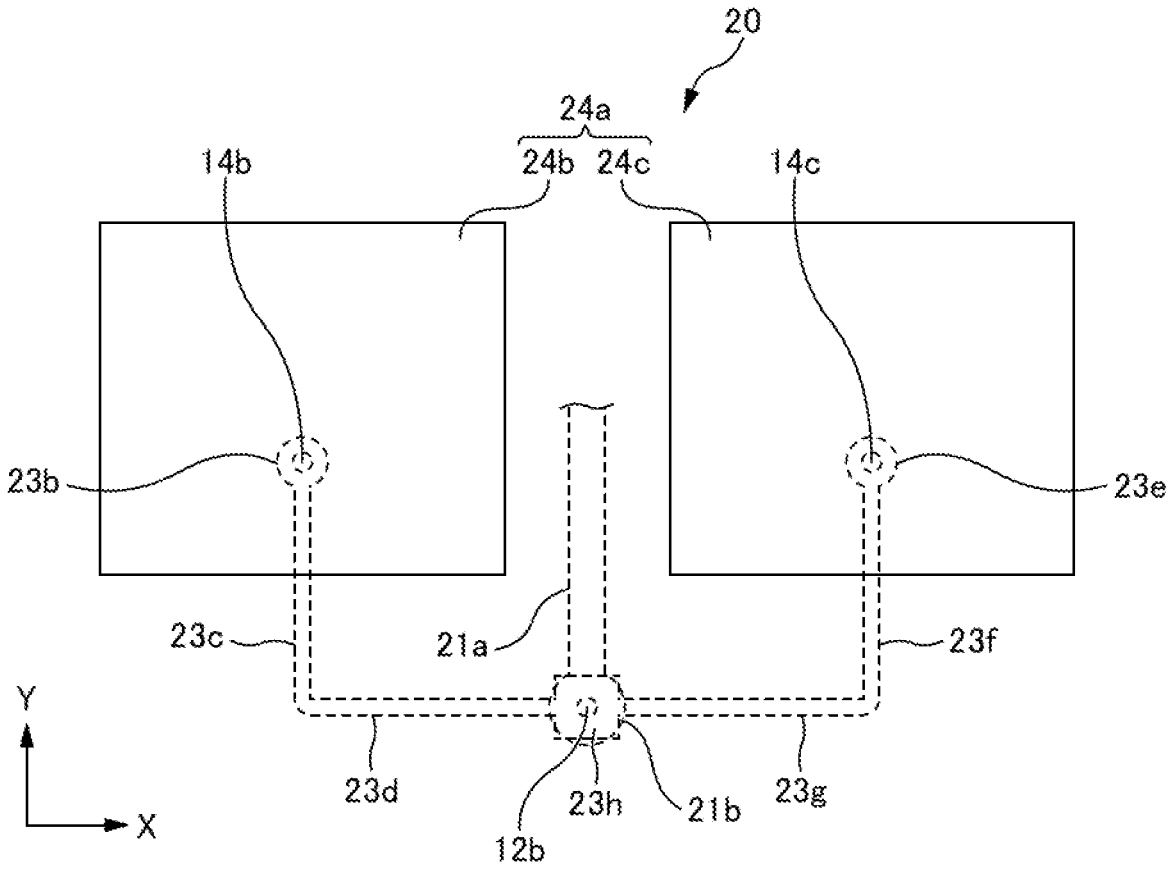
FIG. 13 is a plan view of one antenna set included in an array antenna according to a second embodiment.

FIG. 13 is a plan view illustrating one antenna set 20 of an array antenna according to a second embodiment. Hereinafter, a difference between the array antenna according to the second embodiment and the array antenna 1 according to the first embodiment will be described, and a description of common points is omitted.

In the first embodiment, the line part 23*d* and the line part 23*g* are oblique to the X-axis direction (see FIG. 2).

In contrast, in the second embodiment, a line part 23*d* and a line part 23*g* are parallel to the X-axis direction, an angle θ which the line parts 23*d* and 23*g* form with respect to the X-axis direction is 0°, the line part 23*d* is perpendicular to a line part 23*c*, and the line part 23*g* is perpendicular to a line part 23*f*. Accordingly, the sum of the lengths of the line parts 23*c* and 23*d* is equal to the sum of the lengths of the line parts 23*f* and 23*g*, the length of the line part 23*c* is equal to the length of the line part 23*f*, and the length of the line part 23*d* is equal to the length of the line part 23*g*. In other words, a difference between the physical length of a branch feed line 23*a* from a land part 23*h* to a land part 23*b* and the physical length of the branch feed line 23*a* from the land part 23*h* to a land part 23*e* is 0 mm. Thus, a signal wave transmitted from a first radiation element 24*b* to an RFIC is in phase with a signal wave transmitted from a second radiation element 24*c* to the RFIC. Similarly, a signal wave transmitted from the RFIC to the first radiation element 24*b* is in phase with a signal wave transmitted from the RFIC to the second radiation element 24*c*.

In the second embodiment as well, a feed line 21*a* and the branch feed line 23*a* are formed in different layers, and this improves the degree of freedom in designing the arrangement, wiring path, and the like of the feed line 21*a*.

Note that FIG. 11 also gives a simulation result in a case of the array antenna according to the second embodiment.

Third Embodiment

Figure 14:
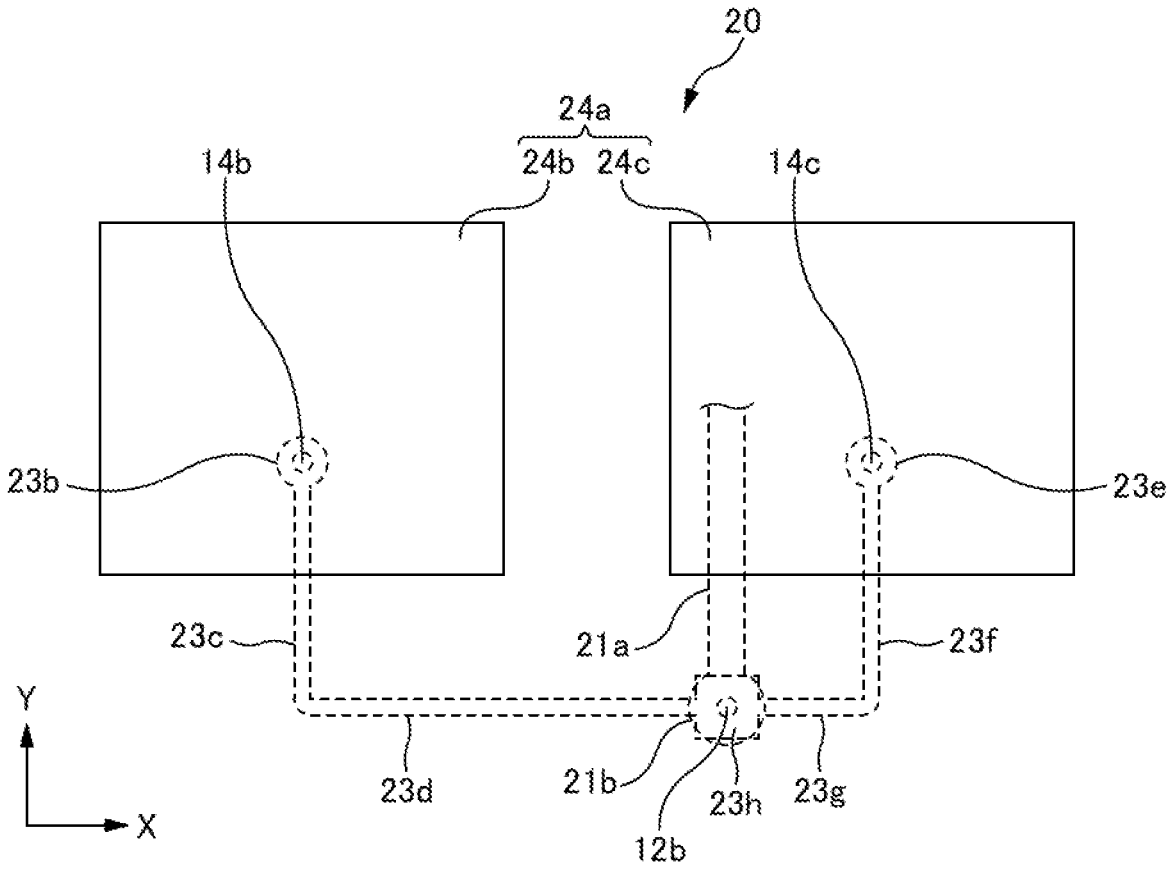
FIG. 14 is a plan view of one antenna set included in an array antenna according to a third embodiment.

FIG. 14 is a plan view illustrating one antenna set 20 of an array antenna according to a third embodiment. Hereinafter, a difference between the array antenna according to the third embodiment and the array antenna 1 according to the second embodiment will be described, and a description of common points is omitted.

In the second embodiment, the land parts 21*b* and 23*h* are arranged at a position shifted in the Y-axis direction from the radiation elements 24*b* and 24*c*, and at a midpoint between the radiation element 24*b* and the radiation element 24*c* in the X-axis direction.

In contrast, in the third embodiment, land parts 21*b* and 23*h* are arranged at a position shifted in the Y-axis direction from radiation elements 24*b* and 24*c*, and at a position shifted in the X-axis direction from the midpoint between the radiation element 24*b* and the radiation element 24*c* to the second-radiation-element 24*c* side. Accordingly, the sum of the lengths of line parts 23*c* and 23*d* is greater than the sum of the lengths of line parts 23*f* and 23*g*, the length of the line part 23*d* is greater than the length of the line part 23*g*, and the length of the line part 23*c* is equal to the length of the line part 23*f*. In other words, the physical length of a branch feed line 23*a* from the land part 23*h* to a land part 23*b* is different from the physical length of the branch feed line 23*a* from the land part 23*h* to a land part 23*e*. Thus, there is a phase difference between a signal wave transmitted from the first radiation element 24*b* to an RFIC and a signal wave transmitted from the second radiation element 24*c* to the RFIC. Similarly, there is a phase difference between a signal wave transmitted from the RFIC to the first radiation element 24*b* and a signal wave transmitted from the RFIC to the second radiation element 24*c*. Such a phase difference produces a plurality of (three) resonance frequencies, and widens a frequency band available in the array antenna 1. This has been specifically verified by simulation, and thus details will be described below.

Figure 15:
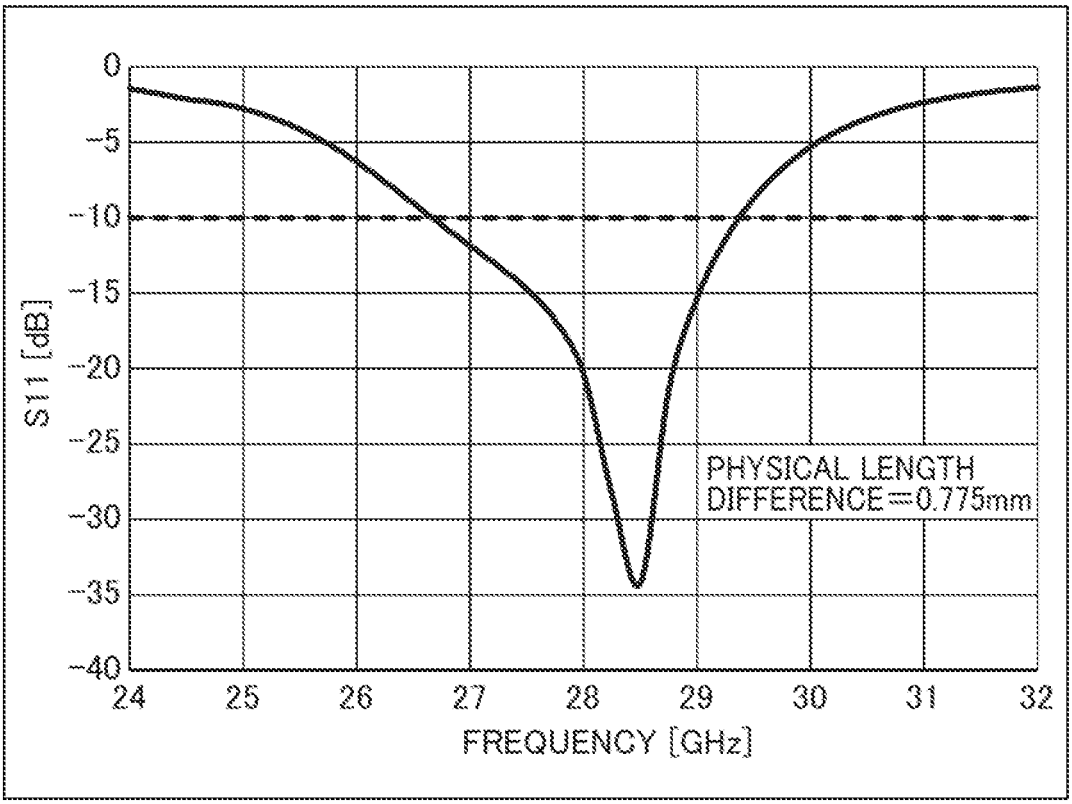
FIG. 15 is a graph illustrating a relationship between a reflection coefficient and a frequency of an array antenna according to a third embodiment when a physical length difference is 0.775 mm.
Figure 16:
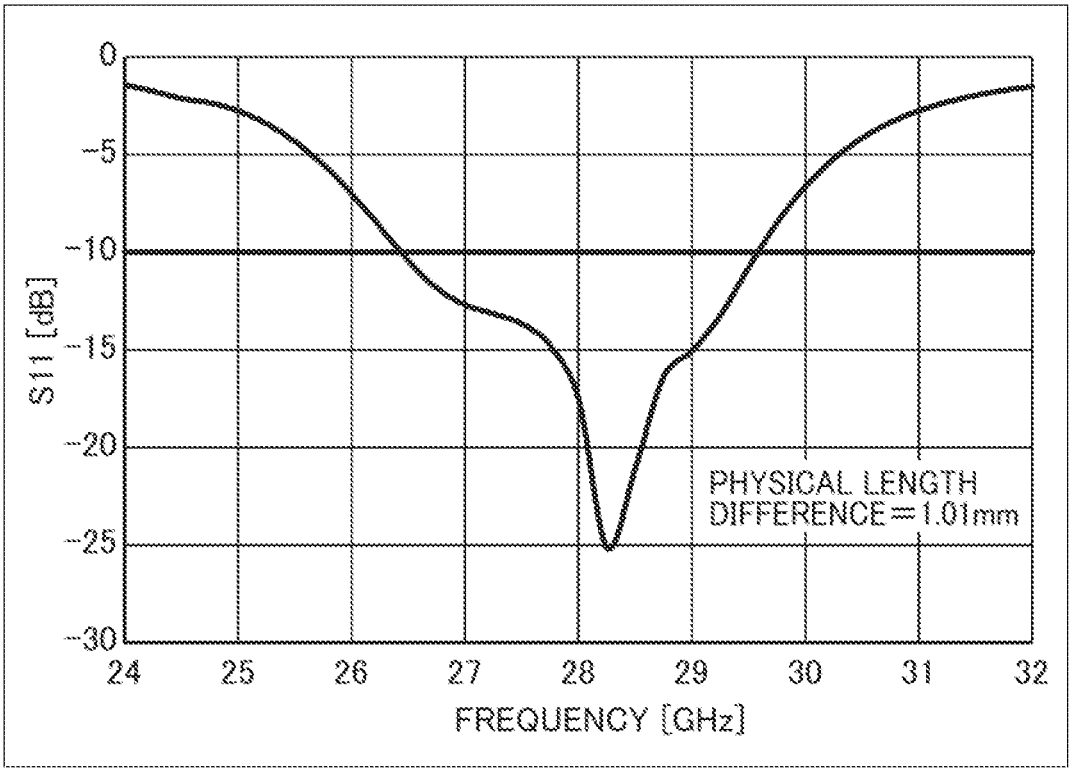
FIG. 16 is a graph illustrating a relationship between a reflection coefficient and a frequency of an array antenna according to a third embodiment when a physical length difference is 1.01 mm.
Figure 17:
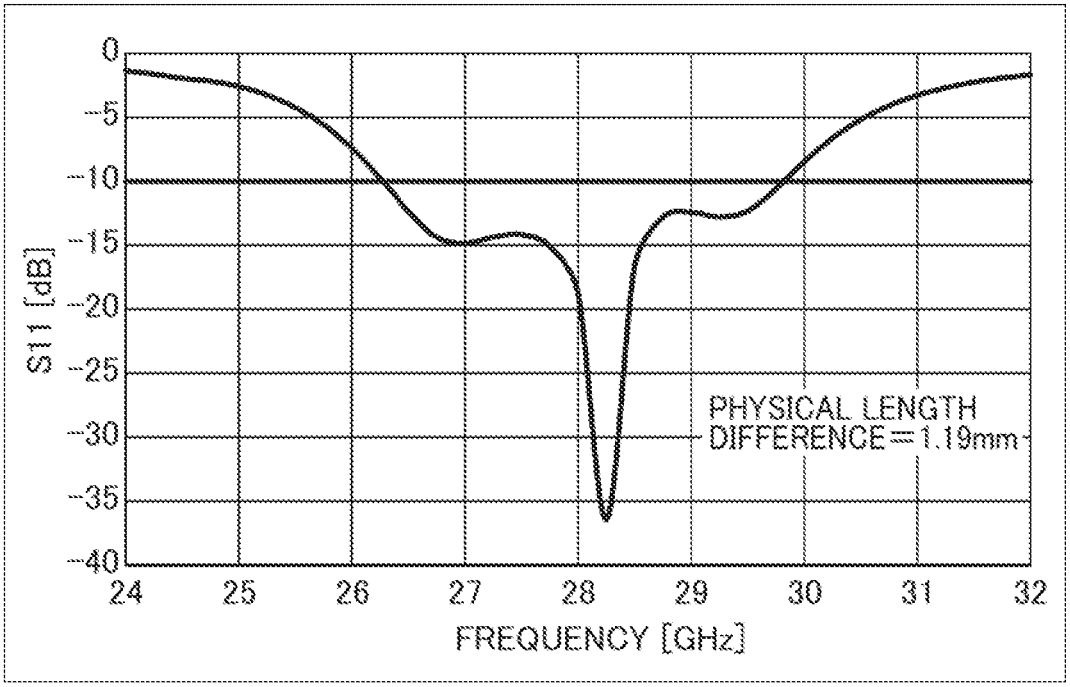
FIG. 17 is a graph illustrating a relationship between a reflection coefficient and a frequency of an array antenna according to a third embodiment when a physical length difference is 1.19 mm.
Figure 18:
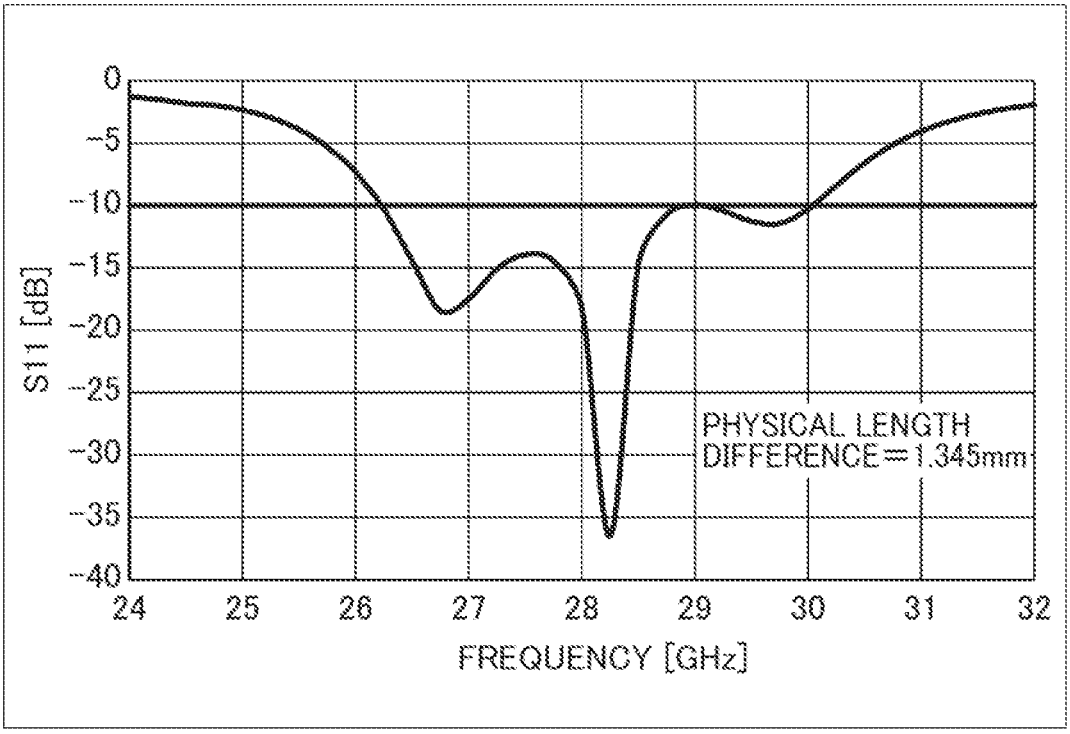
FIG. 18 is a graph illustrating a relationship between a reflection coefficient and a frequency of an array antenna according to a third embodiment when a physical length difference is 1.345 mm.
Figure 19:
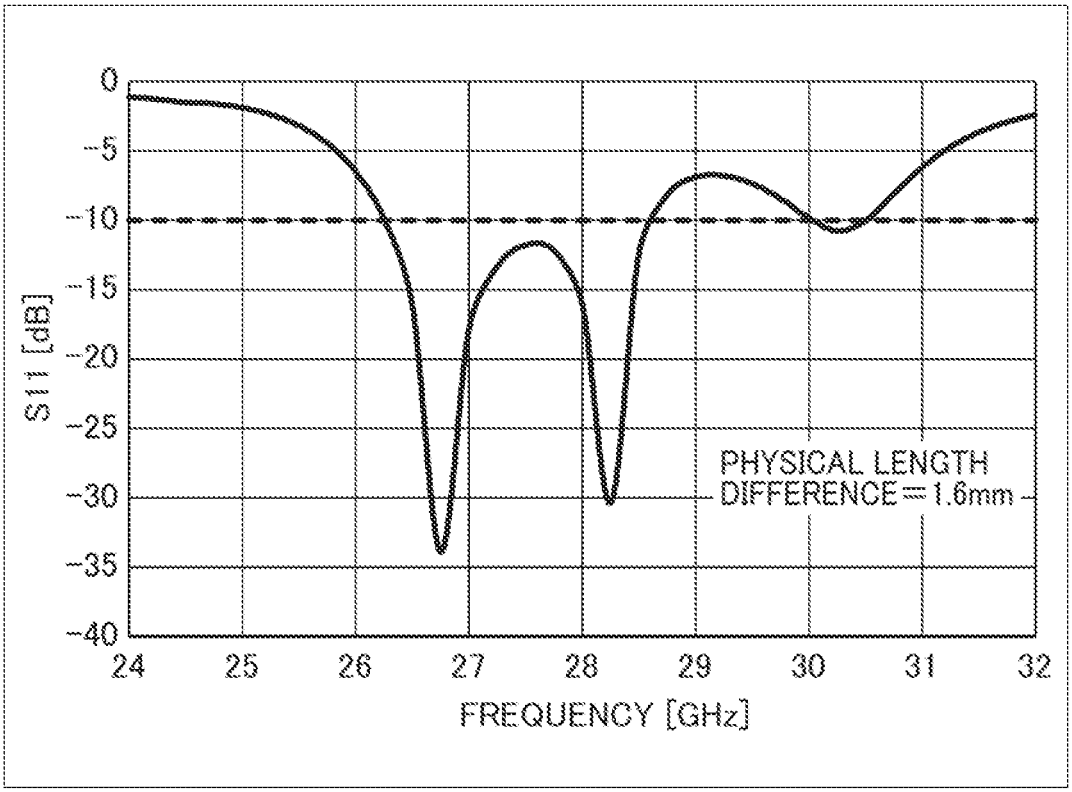
FIG. 19 is a graph illustrating a relationship between a reflection coefficient and a frequency of an array antenna according to a third embodiment when a physical length difference is 1.6 mm.
Figure 20:
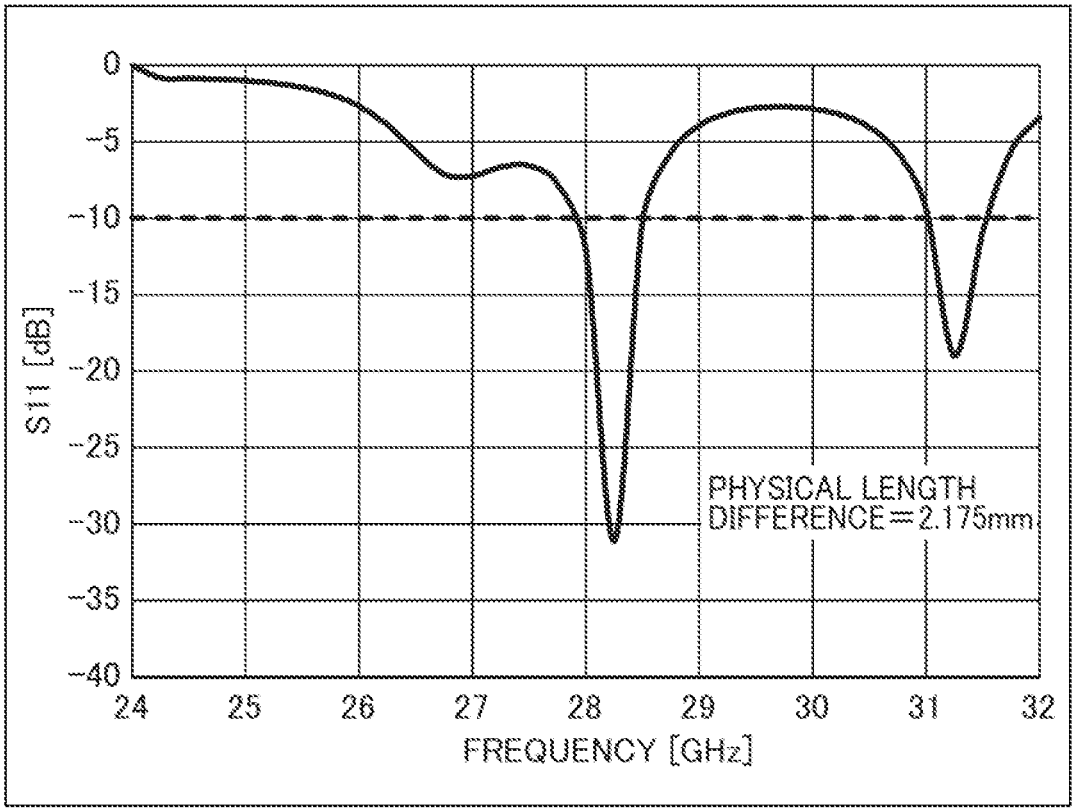
FIG. 20 is a graph illustrating a relationship between a reflection coefficient and a frequency of an array antenna according to a third embodiment when a physical length difference is 2.175 mm.
Figure 21:
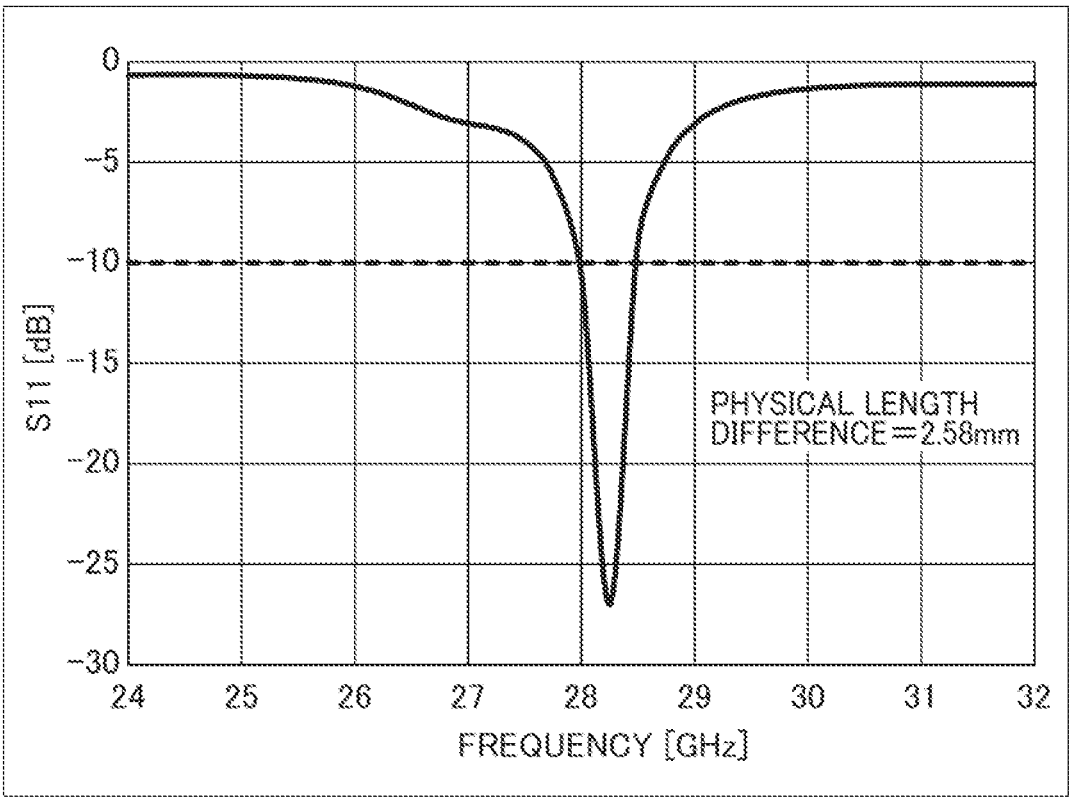
FIG. 21 is a graph illustrating a relationship between a reflection coefficient and a frequency of an array antenna according to a third embodiment when a physical length difference is 2.58 mm.

FIGS. 15 to 21 are frequency characteristic diagrams each illustrating a relationship between a frequency and a reflection coefficient. As illustrated in FIG. 15, when the physical length difference is 0.775 mm, a frequency band with a reflection coefficient equal to or less than −10 dB is 26.75 to 29.25 GHz. As illustrated in FIG. 16, when the physical length difference is 1.01 mm, a frequency band with a reflection coefficient equal to or less than −10 dB is 26.25 to 29.5 GHz. As illustrated in FIG. 17, when the physical length difference is 1.19 mm, a frequency band with a reflection coefficient equal to or less than −10 dB is 26.25 to 29.75 GHz. As illustrated in FIG. 18, when the physical length difference is 1.345 mm, a frequency band with a reflection coefficient equal to or less than −10 dB is 26.25 to 29.0 GHz. As illustrated in FIG. 19, when the physical length difference is 1.6 mm, a frequency band with a reflection coefficient equal to or less than −10 dB is 26.25 to 28.75 GHz and 30.0 to 30.5 GHz. As illustrated in FIG. 20, when the physical length difference is 2.175 mm, a frequency band with a reflection coefficient equal to or less than −10 dB is 28.0 to 28.5 GHz and 31.0 to 31.5 GHz. As illustrated in FIG. 21, when the physical length difference is 2.58 mm, a frequency band with a reflection coefficient equal to or less than −10 dB is 28.0 to 28.5 GHz.

A summary of the above is given by a broken line in a graph in FIG. 12. As is apparent from the broken line in FIG. 12, a frequency bandwidth in a range from when the physical length difference exceeds 0 mm to when the physical length difference is less than approximately 1.4 mm is wider than a frequency bandwidth when the physical length difference is 0 mm. In other words, it is understood that a frequency band available in the array antenna 1 is wider, when the physical length of the branch feed line 23*a* from the land part 23*h* to the land part 23*b* is different from the physical length of the branch feed line 23*a* from the land part 23*h* to the land part 23*e*, with the land parts 21*b* and 23*h* being shifted in the X-axis direction from the midpoint between the radiation element 24*b* and the radiation element 24*c* to the second-radiation-element 24*c* side.

Here, the solid line in FIG. 12 is the simulation result in the first embodiment while the broken line in FIG. 12 is the simulation result in the third embodiment, and accordingly the first embodiment and the third embodiment are compared with reference to FIG. 12. In the first embodiment, with the line part 23*d* and the line part 23*g* being oblique to the X-axis direction, the physical length of the branch feed line 23*a* from the land part 23*h* to the land part 23*b* is different from the physical length of the branch feed line 23*a* from the land part 23*h* to the land part 23*e*. On the other hand, in the third embodiment, with the land parts 21*b* and 23*h* being shifted in the X-axis direction from the midpoint between the radiation element 24*b* and the radiation element 24*c* toward the second radiation element 24*c*, the physical length of the branch feed line 23*a* from the land part 23*h* to the land part 23*b* is different from the physical length of the branch feed line 23*a* from the land part 23*h* to the land part 23*e*.

With reference to FIG. 12, when comparing between the array antenna according to the third embodiment and the array antenna 1 according to the first embodiment having a physical length difference equal to that of the array antenna according to the third embodiment, the array antenna according to the third embodiment has a wider frequency band than that of the array antenna 1 according to the first embodiment in a range from when the physical length difference exceeds 0 mm to when the physical length difference is less than approximately 1.4 mm (corresponding to the angle θ of approximately 16°). When comparing between the array antenna according to the third embodiment and the array antenna 1 according to the first embodiment having a physical length difference equal to that of the array antenna according to the third embodiment, the array antenna 1 according to the first embodiment has a wider frequency band than that of the array antenna according to the third embodiment in a range from when the physical length difference exceeds approximately 1.4 mm (corresponding to the angle θ of approximately 16°) to the physical length difference is less than approximately 2.5 mm (corresponding to the angle θ of approximately 29°).

REFERENCE SIGNS LIST

1 array antenna
10 dielectric layered body
11 protective dielectric layer
12 first dielectric layer
12*b* third through hole conductor
13 second dielectric layer
14 third dielectric layer
14*b* first through hole conductor
14*c* second through hole conductor
15 fourth dielectric layer
21 first conductive pattern layer
21*a* feed line
21*c* line part
22 conductive ground layer
22*a* slot
23 second conductive pattern layer
23*a* branch feed line
23*c* line part (second line part)
23*d* line part (first line part)
23*f* line part (fourth line part)
23*g* line part (third line part)
24 radiation element pattern layer
24*a* radiation element pair
24*b* first radiation element
24*c* second radiation element

The invention claimed is:

1. An array antenna comprising:

a first conductive pattern layer, a first dielectric layer, a conductive ground layer, a second dielectric layer, a second conductive pattern layer, a third dielectric layer, and a radiation element pattern layer that are layered in this order;

a plurality of first through hole conductors and a plurality of second through hole conductors, the plurality of first and second through hole conductors penetrating the third dielectric layer; and a plurality of third through hole conductors penetrating the first dielectric layer, the conductive ground layer, and the second dielectric layer, wherein the radiation element pattern layer includes a plurality of radiation element pairs arranged in a two-dimensional array pattern, each of the plurality of radiation element pairs includes a first radiation element and a second radiation element that are arranged side by side so as to be separated from each other, the plurality of first through hole conductors are arranged in a two-dimensional array pattern so as to correspond to the plurality of first radiation elements, respectively, to be electrically connected to the plurality of first radiation elements, respectively, the plurality of second through hole conductors are arranged in a two-dimensional array pattern so as to correspond to the plurality of second radiation elements, respectively, to be electrically connected to the plurality of second radiation elements, respectively, the second conductive pattern layer includes a plurality of branch feed lines arranged in a two-dimensional array pattern so as to correspond to the plurality of radiation element pairs, respectively, the plurality of third through hole conductors are arranged in a two-dimensional array pattern so as to correspond to the plurality of branch feed lines, respectively, to be electrically connected to the plurality of branch feed lines, respectively, each of the plurality of branch feed lines branches into a first line and a second line, the first line being configured to electrically connect the third through hole conductor and the first through hole conductor, the second line being configured to electrically connect the third through hole conductor and the second through hole conductor, the first conductive pattern layer includes a plurality of feed lines corresponding to the plurality of branch feed lines, respectively, the conductive ground layer includes a plurality of slots arranged in a two-dimensional array pattern so as to correspond to the plurality of branch feed lines, respectively, each of the plurality of feed lines is routed to a position at which the each of the feed lines overlaps each of the slots in a plan view, and each of the plurality of third through hole conductors is arranged on an inner side of each of the slots in a plan view, so as to be electrically insulated from the conductive ground layer and be electrically connected to each of the feed lines.

2. The array antenna according to claim 1, wherein a length of the first line is different from a length of the second line.

3. The array antenna according to claim 2, wherein the first line includes a first line part extending from the third through hole conductor to a first-radiation-element side, and a second line part extending from an end portion, of the first line part, distal from the third through hole conductor toward the first through hole conductor, and the second line includes a third line part extending from the third through hole conductor in a direction opposite to the first line part, and a fourth line part extending from an end portion, of the third line part, distal from the third through hole conductor toward the second through hole conductor, the fourth line part being parallel to the second line part.

4. The array antenna according to claim 3, wherein the first line part and the third line part have an angle with respect to a direction orthogonal to the second line part and the fourth line part.

5. The array antenna according to claim 3, wherein the first line part and the third line part have lengths equal to each other, and the second line part and the fourth line part have lengths different from each other.

* * * * *